US005960945A

United States Patent [19]

Sutherland

[11] Patent Number: 5,960,945

[45] Date of Patent: Oct. 5, 1999

[54] BOTTLE CLIP CARRIER FOR LONG NECK BOTTLES

[75] Inventor: Robert L. Sutherland, Kennesaw, Ga.

[73] Assignee: Riverwood International Corporation, Atlanta, Ga.

[21] Appl. No.: 08/948,700

[22] Filed: Oct. 10, 1997

[51] Int. Cl.[6] ..... B65D 71/42

[52] U.S. Cl. ..... 206/158; 206/147; 206/427

[58] Field of Search ..... 206/147, 151, 206/158, 161, 427; 294/87.2

[56] References Cited

U.S. PATENT DOCUMENTS

| | | | |
|---|---|---|---|
| 4,378,878 | 4/1983 | Graser | 206/147 |
| 4,448,452 | 5/1984 | Wood | 294/87.2 |
| 5,328,024 | 7/1994 | Sutherland | 206/158 |
| 5,407,065 | 4/1995 | Sutherland | 206/147 |
| 5,487,463 | 1/1996 | Harris | 206/151 |

*Primary Examiner*—Jim Foster

[57] ABSTRACT

A bottle neck carrier designed to hold long neck bottles. Long support tabs at each bottle neck opening in a top support panel extend up to the bottle flange, while shorter support tabs contact only the sides of the necks. The tabs may include transverse fold lines to better contact the bottle necks and to provide increased stiffness. In a carrier for packaging two rows of bottles, gusset panels connecting the side and end panels assist in holding the panels in place and facilitate folding of the end panel flaps. In a carrier for packaging a single row of bottles, the end panels are formed from side panel extensions which wrap around the end bottles.

13 Claims, 4 Drawing Sheets

BOTTLE CLIP CARRIER FOR LONG NECK BOTTLES

FIELD OF THE INVENTION

This invention relates to bottle carriers of the type that employ foldable tabs to engage the underside of bottle flanges. More particularly, it relates to a carrier of this type which is particularly adapted to accommodate long neck bottles.

BACKGROUND OF THE INVENTION

One type of carrier used to package beverage bottles, particularly plastic bottles which are not in danger of breaking due to contact with an adjacent bottle, is a clip-type carrier. Bottle clip carriers include a support panel incorporating bottle neck openings through which the necks of the packaged bottles extend. So-called starburst tabs support the bottles when the carrier is lifted. These tabs, which are folded up from the support panel, surround the bottle neck openings and contact the underside of the flange or shoulder that projects out from the bottle neck. Clip-type carriers are quite economical, since they do not require a bottom panel and commonly have only partial side or end panels. In addition, they have ample strength to support the weight of the bottles without tearing.

Although bottle clip carriers are a desirable choice for many bottle packaging applications, they have been utilized primarily in the packaging of short neck bottles. Since the support tabs are formed from flaps extending from the support panel into the bottle neck openings, the height of the support tabs is limited by the diameter of the bottle neck openings. Because the diameter of the bottle neck openings is normally only slightly larger than the diameter of the bottle necks in order to have a tight fit, the possible length of the tabs has been such that they are able to reach only up to the flange on short neck bottles. With new designs of plastic bottles having longer necks, it would be highly desirable to be able to package long neck bottles in bottle clip carriers without sacrificing strength or the necessary tight fit between bottle and carrier.

It is therefore an object of the invention to provide a bottle clip carrier capable of snugly supporting long neck bottles.

BRIEF SUMMARY OF THE INVENTION

In its basic aspects the invention comprises a carrier having a top support panel, opposite side panels connected to the support panel and opposite end panels connected to the side panels. The support panel contains openings through which the necks of packaged bottles extend. A plurality of support tabs connected to the support panel by fold lines extend along portions of the periphery of each bottle neck opening. The support tabs at each bottle neck opening include a plurality of spaced relatively long support tabs having edges engaging the underside of the shoulder of an associated bottle neck, and a plurality of spaced relatively short support tabs engaging the bottle neck between the relatively long support tabs.

In one arrangement the support panel is connected to the side panels by fold lines, and at least some of the relatively long support tabs are connected to the support panel by fold lines which at least partially coincide with the fold lines connecting the support panel to the side panels. The relatively long support tabs may include a transverse fold line, enabling the support tabs to fold upwardly about the transverse fold lines to provide improved stiffness. The relatively short support tabs may also include transverse fold lines as well. In another arrangement a relatively long support tab at each of the corner bottle neck openings in a carrier designed to hold two rows of bottles extends diagonally to the fold lines connecting the support panel to the side panels to take maximum effect of the bottle neck slope and the corner support.

In a two-row carrier, the carrier may include gusset panels connected to adjacent side and end panels by fold lines which facilitate folding of the side panels and which hold side panel extensions in place prior to gluing. In a single row carrier side panel extensions form the end panel by being wrapped around the outer curved portions of the end bottles.

Both embodiments of the carrier are inexpensive to produce and apply, yet they provide a support tab arrangement which is capable of readily supporting long neck bottles and snugly holding them in place. The features which enable the carrier to function in this manner are brought out in more detail in connection with the description of the preferred embodiments, wherein the above and other aspects of the invention, as well as other benefits, will readily become apparent.

DETAILED DESCRIPTION OF THE PREFERRED EMBODIMENTS

Figure 1:
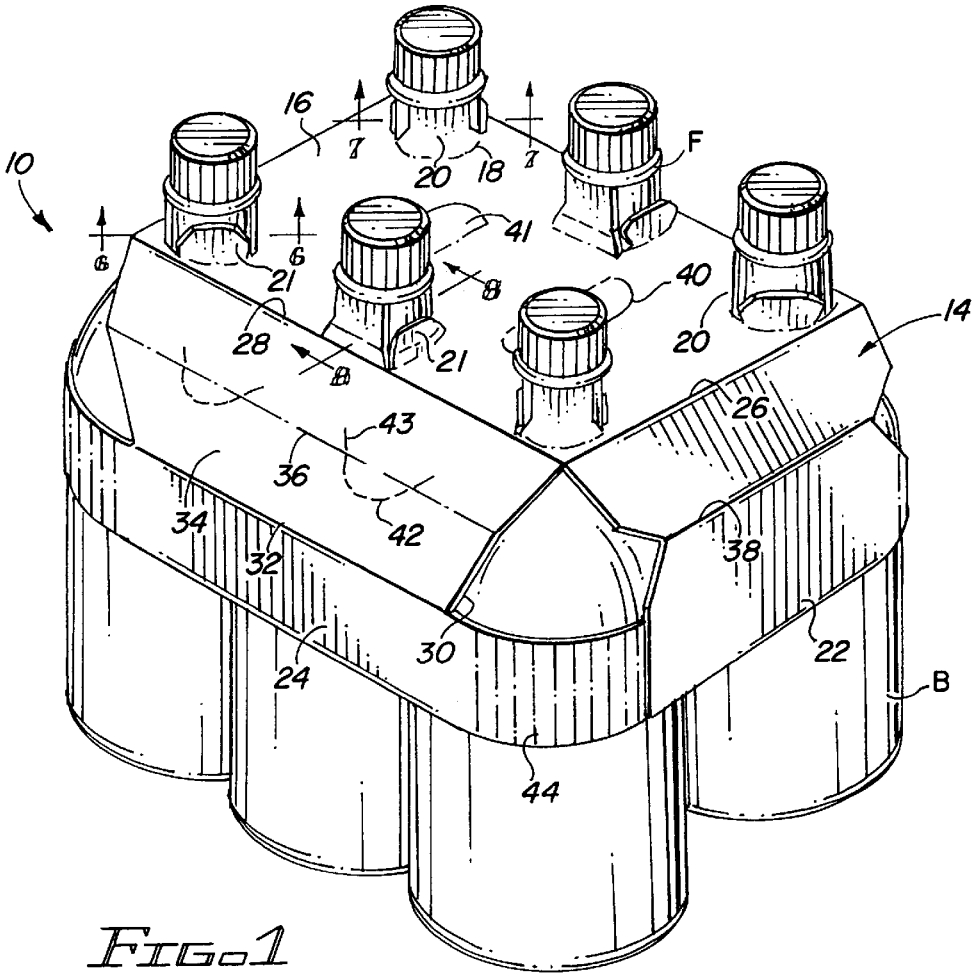
FIG. 1 is a pictorial view of one embodiment of the carrier-of the invention.

Referring to FIG. 1, the package 10 is comprised of two rows of three bottles B and a carrier 14 which contains the bottles. The carrier includes a top support panel 16 containing openings 18 through which the necks of the bottles extend. Tabs 20 and 21, which are connected to the panel 16 by fold lines extending about the periphery of the bottle neck openings 18, are of different heights, with the shorter tabs 21 contacting only the bottle necks and the longer tabs 20 contacting both the bottle necks and the underside of the bottle flanges F to support the bottles when the carrier is lifted. The support panel 16 is connected to end panels 22 and side panels 24 by fold lines 26 and 28, respectively, which meet at the corners of the carrier. Corner cutouts 30 extend down from the intersection of the fold lines 26 and 28, and fold lines 32 in the side panels 24 extend between the lower edges of the cutouts, forming sloped side panel sections 34 which generally conform to the slope of the bottles in the transition area between the bottle neck and the barrel of the bottle. An additional fold line 36 in the sloped panel sections 34 and an additional fold line 38 in the end panels allow the side and end panels to conform even more closely to the contour of the bottles. The fold lines 32 and 36 are parallel to the fold lines 28. Similarly, the fold lines 38 are parallel to the fold lines 26.

This construction produces a carrier having short partial side and end panels which snugly engage the bottles and have rounded corner areas adjacent the corner bottles. Finger holes 40 covered by tabs 41 in the top panel 16 function as a handle to allow the carrier to be lifted. Alternative finger holes formed by tear lines 42 are provided in the sloped side panel sections 34. The tear lines terminate at the fold lines 36, and slits 43 extend up from the fold lines 36. In addition, score lines 44 are provided in the extended corner portions of the side panels 24 to allow the side panels to follow the curved contour of the corner bottles in these areas.

Figure 2:
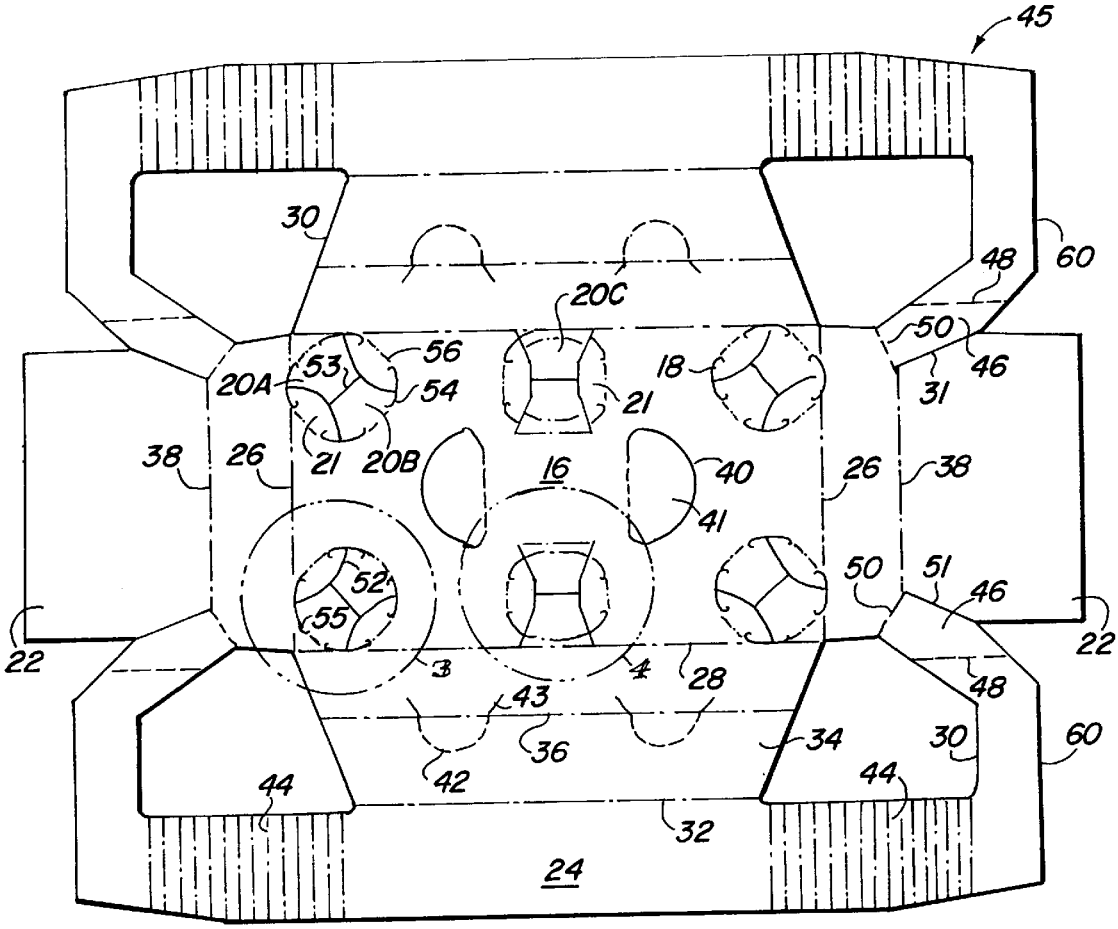
FIG. 2 is a plan view of a blank for forming the carrier of FIG. 1.

A blank 45 for forming the carrier is shown in FIG. 2, wherein like reference numerals to those used in FIG. 1 denote similar elements. The blank is preferably formed of paperboard, but may be of any suitable material having sufficient strength and flexibility to function in the manner of paperboard. The blank is comprised of a centrally located top support panel section 16 connected by the fold lines 26 to end panel flaps 22 and by the fold lines 28 to side panel flaps 24. The side panel flaps 24 are longer than the length of the support panel section 16, terminating beyond the cutouts 30. Gusset panels 46 are connected to the side panel flaps 24 along fold lines 48 and to the end panel flaps 22 along fold lines 50. Slits 51 separate the gusset panels from the end panels 22 and terminate at the intersection of fold lines 38 and 50. The fold lines 48 are substantially parallel to the fold lines 28 and the fold lines 50 are angled with respect to the fold lines 38 and 48.

Figure 3:
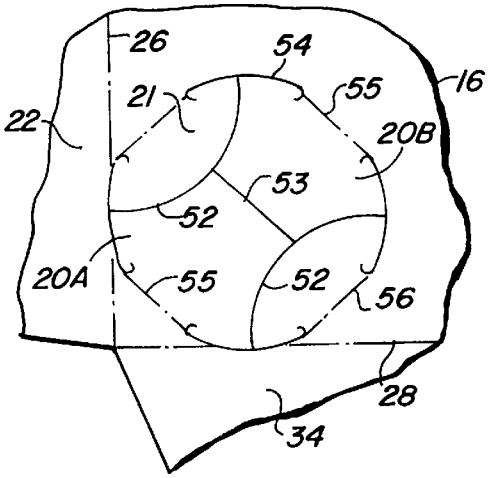
FIG. 3 is an enlarged plan view of the area within the circle 3 in FIG. 2.
Figure 4:
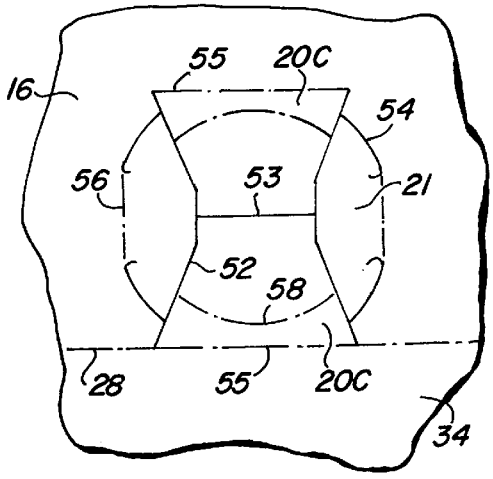
FIG. 4 is an enlarged plan view of the area within the circle 4 of FIG. 2.

As is conventional, the diameter of the bottle neck openings 18 in the top support panel section 16 is related to the diameter of the neck portion of the bottles to be packaged so that the shoulder or flange of the bottle neck is able to pass through the opening while contacting the support tabs to pivot them up about their fold lines. Referring to FIGS. 3 and 4 as well as FIG. 2, it can be seen that the support tabs 20 and 21 at the corner bottle neck openings are of somewhat different design than the support tabs 20 and 21 at the central bottle neck openings. In both cases the support tabs take the form of four contiguous tabs arranged so that the fold lines of adjacent tabs are at right angles to each other. Slits 52 and 53 separate the tabs and arcuate slits 54 separate the tab fold lines. In both cases one pair of oppositely located tabs is longer than the other pair. In the corner bottle neck openings the lengths of the pair of tabs 20A and 20B, as measured from their fold lines 55 to their end edges, are greater than the lengths of the pair of tabs 21, as measured from their fold lines 56 to the farthest extent of their end edges. In the central bottle neck openings the pair of tabs 20C are longer than the pair of tabs 21. In addition, the tabs 20A are slightly longer than the opposite tabs 20B for the reason explained below. The fold lines 55 of the tabs 20A extend diagonally between the top panel section fold lines 26 and 28, while the fold lines 55 of the outermost of central tabs 20C substantially coincide with the top panel section fold lines 28. The arcuate slits 54 of the corner bottle neck openings partially coincide, or may extend slightly beyond, the top panel section fold lines 26 and 28, while the arcuate slits 54 of the central bottle neck openings terminate at the sides of the support tabs 20C, short of the fold lines 28.

The blank 45 includes groups of the parallel score lines 44 in the side panel flaps 24. These score lines are parallel to the fold lines 26 and extend from the cutouts 30 to the outer edge of the side panel flaps. Arcuate score lines 58 are also provided in the support tabs 20C, spaced a short distance from the tab fold lines.

Figure 5:
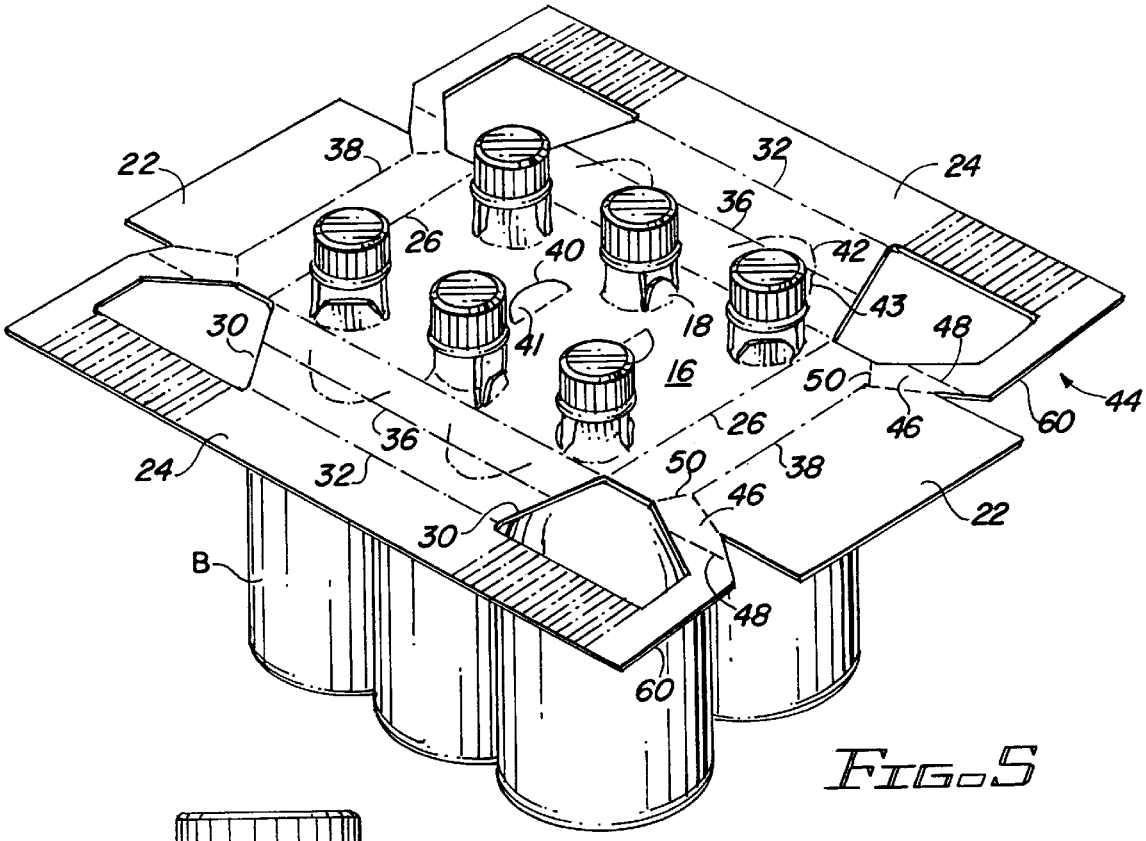
FIG. 5 is a pictorial view of the initial stage of carrier formation, showing the blank after it has been attached to the bottles.

To form a package, the bottles to be packaged are grouped together and the blank 45, after being properly aligned, is pushed down over the tops of the bottles. The upper ends of the bottles move through the openings 18 in the support panel section 16, pivoting the support tabs up. Relative upward movement of the bottles continues until the support tabs 20A, 20B and 20C snap into place as the edges of these tabs engage the underside of the bottle flanges F. The shorter tabs 21 do not reach the flanges F but snugly engage the bottle necks. The blank at this stage is illustrated in FIG. 5. Next, the gusset panels 46 are folded down about fold lines 50 and up about fold lines 48, causing the gusset panels to contact the underside of the end panel flaps 22. It may be preferred during this step to pivot the end panel flaps 22 up about their fold lines 26, which elevates the fold lines 50 and causes the side panel flaps to automatically begin to fold down about the fold lines 28, thereby facilitating the folding of the gusset panels. The end edges 60 of opposite side panel flaps 24 are moved toward each other during this folding sequence, causing the end portions of the side panel flaps to curve around the adjacent corner bottles until they are in their final position. The end panel flaps 22 are then folded down and glued to the underlying portions of the side panel flaps 24 to produce the final package shown in FIG. 1.

The score lines 44 facilitate the curving of the side panel flaps 24 about the corner packaged bottles. Because the flaps follow the contour of the bottles instead of meeting in a folded corner arrangement spaced from the adjacent bottle, the bottles are snugly held in place. The cutouts 30 at the corners of the package eliminate material which would tend to be compressed into unsightly irregular creases and folds when the panel flaps 24 are folded into place, and minimize the size of the gusset panels. They also provide biting edges which contact the bottles, further preventing the bottles from moving. Although relatively large cutouts provide these beneficial results, including minimizing the length of the gusset fold lines 48 in order to reduce resistance against folding of the gusset panels, the gusset fold lines 50 should remain of a length which provides enough force to pull the side panel flaps 24 into place upon folding of the gusset panels. The gusset panels cause the side panels to move into place so as to snugly conform to the curvature of the corner bottles in the package and maintain the end panels in that position prior to gluing the end panels to the end portions or extensions of the side panels.

Figure 6:
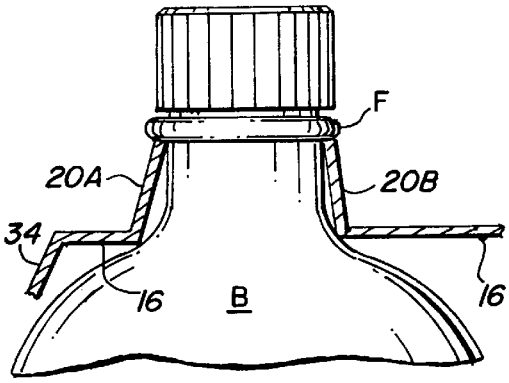
FIG. 6 is an enlarged partial transverse sectional view taken along the line 6—6 of FIG. 1.
Figure 7:
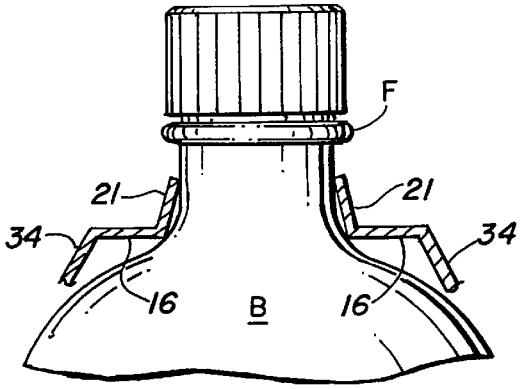
FIG. 7 is an enlarged partial transverse sectional view taken along the line 7—7 of FIG. 1.
Figure 8:
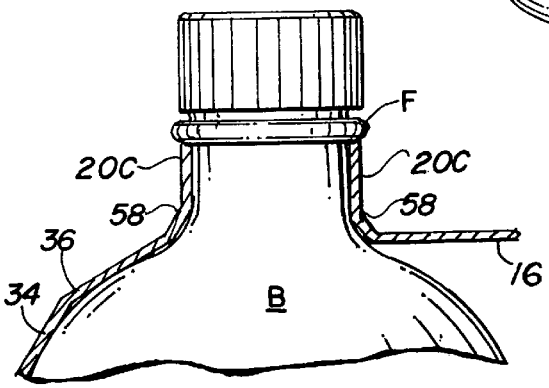
FIG. 8 is an enlarged partial transverse sectional view taken along the line 8—8 of FIG. 1.

When the carrier is lifted by the finger holes 40, the top support panel tends to bow up in the middle, with the bow extending generally along the length of the carrier. The slightly greater height of the tabs 20A than the tabs 20B accommodates the bowing of the carrier to allow the support edges of both the tabs 20A and 20B to contact the bottle flanges and to maintain them in generally horizontal condition even though the fold lines of the tabs 20B are slightly higher due to the bowing than the fold lines of the tabs 20A. If the outer tabs 20A were not made slightly higher, there could be a gap between the outer tab edges and the bottle flange when the carrier is lifted, with possible loss of support at this point of the flange. This arrangement is illustrated in FIG. 6, which shows the ends of the support tabs 20A and 20B engaging the underside of the flange F while the two segments of the top support panel 16 are in slightly vertically separated planes. As shown in FIG. 7, the support tabs 21 do not reach the flange F but do snugly engage the sides of the bottle neck to assist in supporting the bottles. It can now be appreciated that the support tabs 21 necessarily are shorter than the support tabs 20 in order for the support tabs 20 to be of a length to reach the flange of a packaged bottle. Both tabs 20 and 21 cannot be made to reach the flange in view of the limited size of the bottle neck openings. The opposite support tabs 20C need not be of different heights because their fold lines are at right angles to the bowing and do not experience different distances to the bottle flange. As illustrated in FIG. 8, the arcuate score lines 58 allow the tabs 20C to better follow the slope of the bottle necks. The tabs 21 of the central bottle neck openings function similarly to the tabs 21 of the corner bottle neck openings.

If the side grip finger holes are used to lift the carrier, usually the thumb and middle finger of one hand are employed to push the cover tabs inwardly from the tear lines 42. When the carrier is lifted, the fold lines 28 immediately above the side finger holes receive much of the lifting stresses. Since the fold lines 28 and adjacent areas of the side and top panels are quite strong compared to other planar panel surfaces of the carrier, they provide stiffness and resistance against tearing, making the carrier quite capable of being lifted and carried in this manner without risk of failure. Lifting of the carrier in this manner still results in a certain amount of bowing of the carrier, which allows the support tab configurations discussed above to continue to be effective.

The diagonal tab fold lines 55 are offset from the package corners and from the fold lines 26 and 28, thereby taking maximum advantage of the bottle neck slope at this point and of the strength of the package corner supports. By making the fold lines of the outer support tabs 20C coincide with the fold lines 28, lifting stresses at these critical locations are distributed directly to the side panel fold lines 28 without first having to travel through part of the support panel, and so add to the strength of the carrier. The arcuate scores in the support tabs 20C provide lift support and exert an inward push upon lifting the package to provide additional support tab stiffness.

It was noted above that the slits 54 in the central bottle neck openings meet the edges of tabs 20C at a point spaced from the side panel fold line 28. This makes it even more unlikely for tearing to occur at the ends of the outer support tabs 20C.

Figure 9:
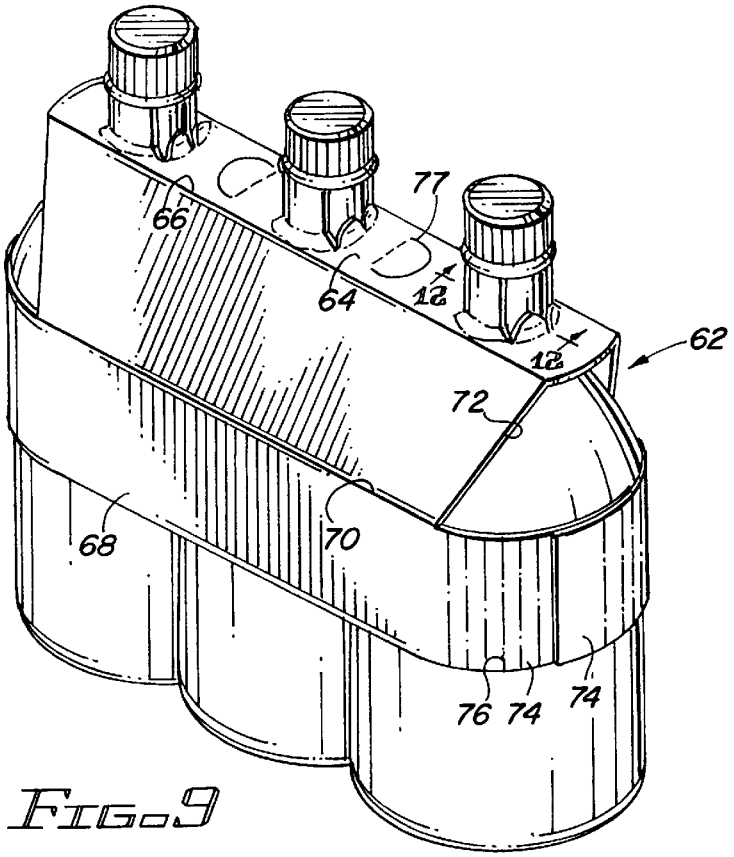
FIG. 9 is a pictorial view of a second embodiment of the invention.

Another embodiment of the invention is shown in FIG. 9, which illustrates a package consisting of only a single row of bottles. In this arrangement the carrier 62 is comprised of a narrow top support panel 64 connected by fold lines 66 to side panels 68. As in the first embodiment the side panels include a fold line 70 which allows the upper portions of the side panels to slope in accordance with the slope of the bottles. End cutouts 72 separate the top panel from the end panels, which consist of side panel extensions 74 wrapped around the end bottles. Score lines 76 in the side panel extensions serve the same purpose as the score lines 42 in the first embodiment. Long support tabs 20D, arranged similarly to the support tabs 20C of the first embodiment, engage the flanges F of the bottles, while shorter support tabs 21D engage the bottle necks. Finger holes 77 are provided in the top panel 64 for lifting the carrier. As a practical matter, a single-row carrier is more likely to be used with larger heavier bottles than with the size bottles normally packaged in a two-row carrier.

Figure 11:
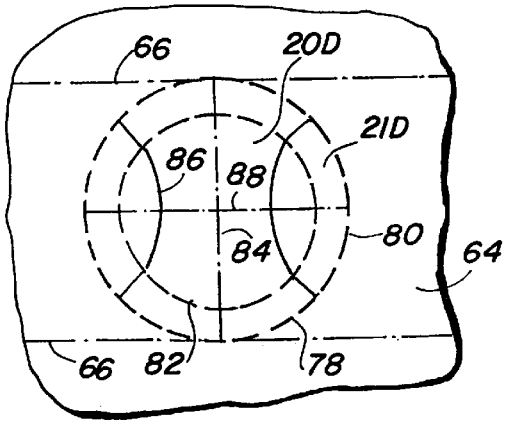
FIG. 11 is an enlarged plan view of the area within the circle 11 in FIG. 10.
Figure 10:
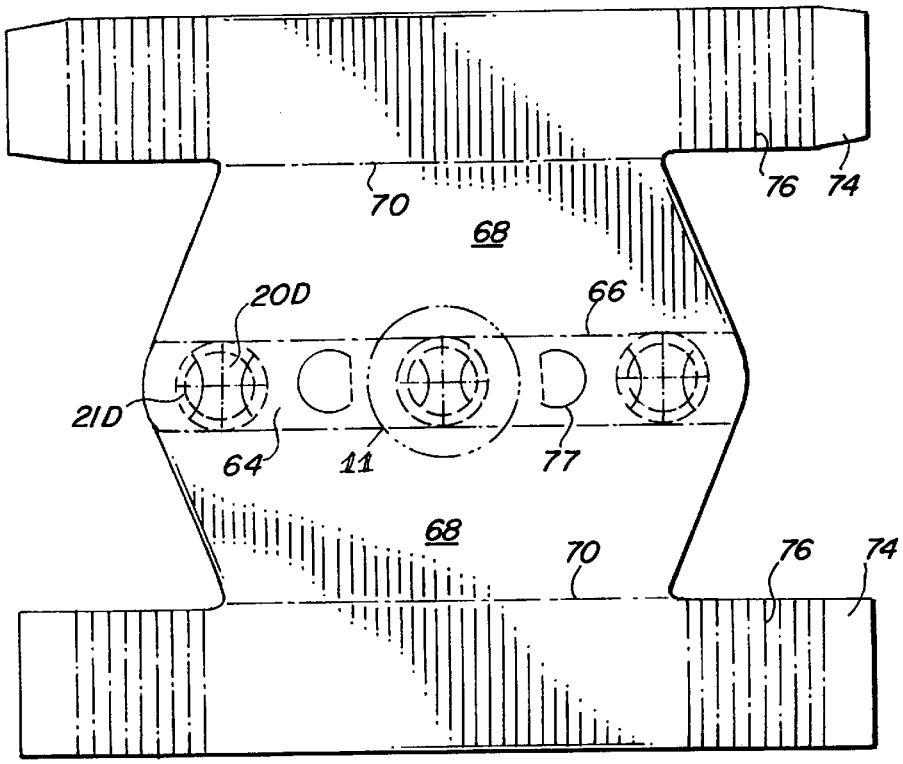
FIG. 10 is a plan view of a blank for forming the carrier of FIG. 9.

A blank for forming the carrier 62 is shown in FIG. 10 to consist of a centrally located top panel section 64 connected by the fold lines 66 to side panel sections 68. The upper edges of the side panel extensions 74 are substantially aligned with the fold lines 70. As shown more clearly in FIG. 11, the support tabs 20D are connected to the top support panel 64 by arcuate fold lines 78 which, when extended, form the arcuate fold lines 80 of the support tabs 21D. An arcuate score line 82 extends through all the support tabs 20D and 21D to provide the same advantages discussed in connection with the arcuate fold line 58 of the tabs 20C. Added stiffness is provided to the support tabs 20D by score lines 84, which extends between the fold lines 78, bisecting the tabs 20D. The tabs are formed, as in the blank of the first embodiment, by slits 86 and 88, except that in this case the slit 88 extends between the fold lines 80, forming two short support tabs 21D on opposite sides of the bottle neck opening instead of one.

Figure 12:
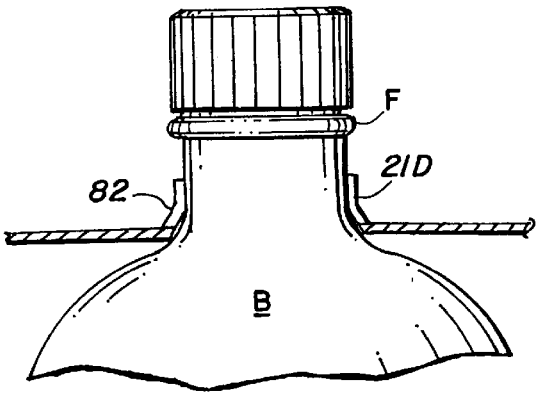
FIG. 12 is an enlarged partial transverse sectional view taken along the line 12—12 of FIG. 9.

When the carrier is lifted the tabs 20D function in the manner of support tabs 20C, folding at the score lines 82, but having the additional capability of being able to better follow the transversely curved contour of the bottle necks due to the score line 84. As shown in FIG. 12, the arcuate scores in the support tabs 21D allow the tabs to fold inwardly as the carrier is lifted, providing lift support and exerting an inward push as discussed above in connection with the functioning of the support tabs 20C. The narrow width of the tabs 21D created by the slit 88 facilitates the folding of the tabs, inasmuch as a short tab of twice the width would have a more difficult time folding inwardly as designed. Although side finger holes could be provided if desired, they have not been illustrated in this embodiment since a heavy single-row carrier is more readily lifted by top handle openings than by side grips.

Although the bottles have been shown as having a separate integral flange, the terms "flange" or "shoulder" as used in the specification and claims are intended to include the underside of bottle caps in bottles which do not incorporate an integral flange. Also, although the panels that include the curved portions of the carrier have been designated as side panels, it will be understood that either pair of opposite panels may be considered as the end or side panels in a carrier whose support panel is square.

It can now be appreciated that the invention provides a unique support carrier which incorporates support tabs designed to support long neck bottles. The features enabling the carrier to function in this way are incorporated into the carrier without requiring expensive carrier blanks or complicated maneuvers by packaging machines. It will be understood that the invention is not limited to all the specific details described in connection with the preferred embodiments, except as they may be within the scope of the appended claims. Changes to certain features of the preferred embodiments which do not alter the overall basic function and concept of the invention are therefore contemplated.

What is claimed is:

1. A package, comprising:

a carrier including a top support panel, opposite side panels connected to the support panel and opposite end panels connected to the side panels;

a plurality of bottles having a neck which includes an outwardly projecting shoulder;

the support panel containing openings through which the necks of the bottles extend;

a plurality of support tabs connected to the support panel by fold lines extending along portions of the periphery of each bottle neck opening;

the support tabs at each bottle neck opening including a plurality of spaced relatively long support tabs having edges engaging the underside of the shoulder of the associated bottle neck, and a plurality of spaced relatively short support tabs engaging the bottle neck between the relatively long support tabs;

the carrier contains two rows of bottles and the support panel includes four corners and bottle neck openings adjacent the corners, one of the relatively long support tabs at each of the corner bottle neck openings being closer to the corners than the other relatively long support tabs, said closer support tabs extending diagonally to the fold lines connecting the support panel to the side panels; and said closer relatively long support tabs are slightly longer than the other relatively long support tabs.

2. A package as defined in claim 1, wherein the support panel is connected to the side panels by fold lines, at least some of the relatively long support tabs being connected to the support panel by fold lines which at least partially coincide with the fold lines connecting the support panel to the side panels.

3. A package as defined in claim 2, wherein said some relatively long support tabs include a transverse fold line, said some relatively long support tabs being folded upwardly about the transverse fold lines.

4. A package as defined in claim 1, wherein at least some of the relatively short support tabs have a relatively narrow width compared to the width of the relatively long support tabs.

5. A package as defined in claim 4, wherein said some relatively short support tabs include a transverse fold line, said some relatively short support tabs being folded upwardly about the transverse fold lines.

6. A package as defined in claim 1, wherein the opposite end panels are connected to the support panel by fold lines, the carrier including gusset panels connected to adjacent side and end panels by fold lines and the side panels including extensions, the gusset panels and extensions of the side panels underlying and being adhered to the end panels.

7. A package as defined in claim 6, wherein the extensions of the side panels extend about outer curved portions of adjacent bottles.

8. A blank for forming a carrier for supporting bottles having a neck which includes an outwardly projecting shoulder, comprising:

a centrally located top support panel section connected by fold lines to opposite side panel flaps;

the support panel section containing openings through which the necks of packaged bottles extend;

a plurality of support tabs connected to the support panel by fold lines extending along portions of the periphery of each bottle neck opening;

the support tabs at each bottle neck opening including a plurality of spaced relatively long support tabs of a length designed to reach the underside of the shoulder of an associated packaged bottle, and a plurality of spaced relatively short support tabs designed to engage the necks of packaged bottles;

opposite end panel flaps connected to the support panel section by fold lines, the support panel section containing two rows of bottle neck openings and including four corners, each corner being adjacent a bottle neck opening, one of the relatively long support tabs at each of the corner bottle neck openings being closer to the corners than the other relatively long support tabs, said closer support tabs extending diagonally to the fold lines connecting the support panel section to the side and end panel flaps; and said closer relatively long support tabs are slightly longer than the other relatively long support tabs.

9. A blank as defined in claim 8, wherein at least some of the relatively long support tabs are connected to the support panel section by fold lines which at least partially coincide with the fold lines connecting the support panel section to the side panel flaps.

10. A blank as defined in claim 9, wherein said some relatively long support tabs include a transverse fold line, said some relatively long support tabs being designed to fold upwardly about the transverse fold lines in a carrier formed from the blank.

11. A blank as defined in claim 8, wherein at least some of the relatively short support tabs have a relatively narrow width compared to the width of the relatively long support tabs.

12. A blank as defined in claim 11, wherein said some relatively short support tabs include a transverse fold line, said some relatively short support tabs being designed to fold upwardly about the transverse fold lines in a carrier formed from the blank.

13. A blank as defined in claim 8, wherein the blank includes opposite end panel flaps connected to the support panel section by fold lines, the blank including gusset panels connected to adjacent side and end panel flaps by fold lines and the side panel flaps including extensions, the gusset panels and extensions of the side panels being designed to underlie the end panels in a carrier formed from the blank.

* * * * *